United States Patent [19]

Porter

[11] 4,295,438

[45] Oct. 20, 1981

[54] RESCUE LOCATOR SIGNAL PACKAGE

[76] Inventor: Howard L. Porter, Rte. 5, Box 83, Lake Placid, Fla. 33852

[21] Appl. No.: 124,097

[22] Filed: Feb. 25, 1980

[51] Int. Cl.[3] ..... G09F 9/00

[52] U.S. Cl. ..... 116/210; 9/9; 116/DIG. 8

[58] Field of Search ..... 116/210, DIG. 8, DIG. 9; 9/9

[56] References Cited

U.S. PATENT DOCUMENTS

| | | | |
|---|---|---|---|
| 827,350 | 7/1906 | Crofford | 116/210 X |
| 2,830,309 | 4/1958 | Lawson | 9/9 |
| 3,721,983 | 3/1973 | Sherer | 116/210 |
| 4,042,882 | 8/1977 | Camacho et al. | 116/210 |
| 4,052,955 | 10/1977 | Haushalter | 116/210 |
| 4,102,296 | 7/1978 | Felix | 9/9 X |
| 4,114,561 | 9/1978 | Asaro | 116/210 |

*Primary Examiner*—Daniel M. Yasich
*Attorney, Agent, or Firm*—Paul H. Gallagher

[57] ABSTRACT

A device for producing a rescue signal for use by a person who is lost or has had an accident. The device is in the form of a compact package including a casing containing a deflated and collapsed balloon, and a cartridge of compressed gas, such as helium, air, or $CO_2$, and a hand lever for forcing the cartridge to puncture it. A needle tube has a first, pointed, end for puncturing the cartridge, and a second end extending into the balloon, and the balloon has a sphincter valve normally holding the balloon on the needle tube, and closing when the balloon is inflated and released. A pull tab is provided on the balloon for grasping by the user for releasing the balloon, and a tether line is tied to the balloon and wound on a spool. The casing is normally closed, confining nearly all of the other components and readily opened manually for exposing those elements. It may be small and light in weight for carrying on the person as in hiking, ski-ing, mountain climbing, etc., or for scuba diving, or it may be larger for carrying in a car, a boat, airplane, etc. The device is made of inexpensive material and may be considered a throw-away item.

5 Claims, 5 Drawing Figures

Fig. 1.
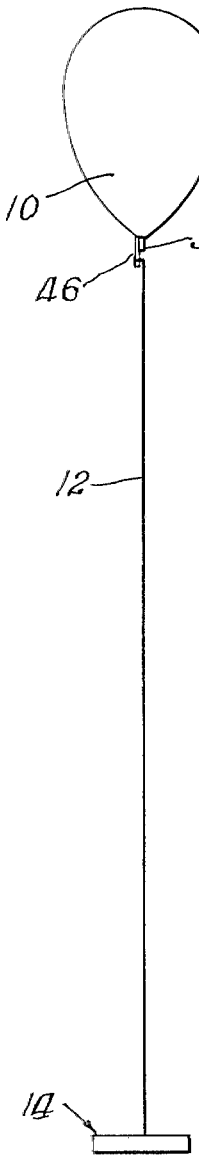
Fig. 2.
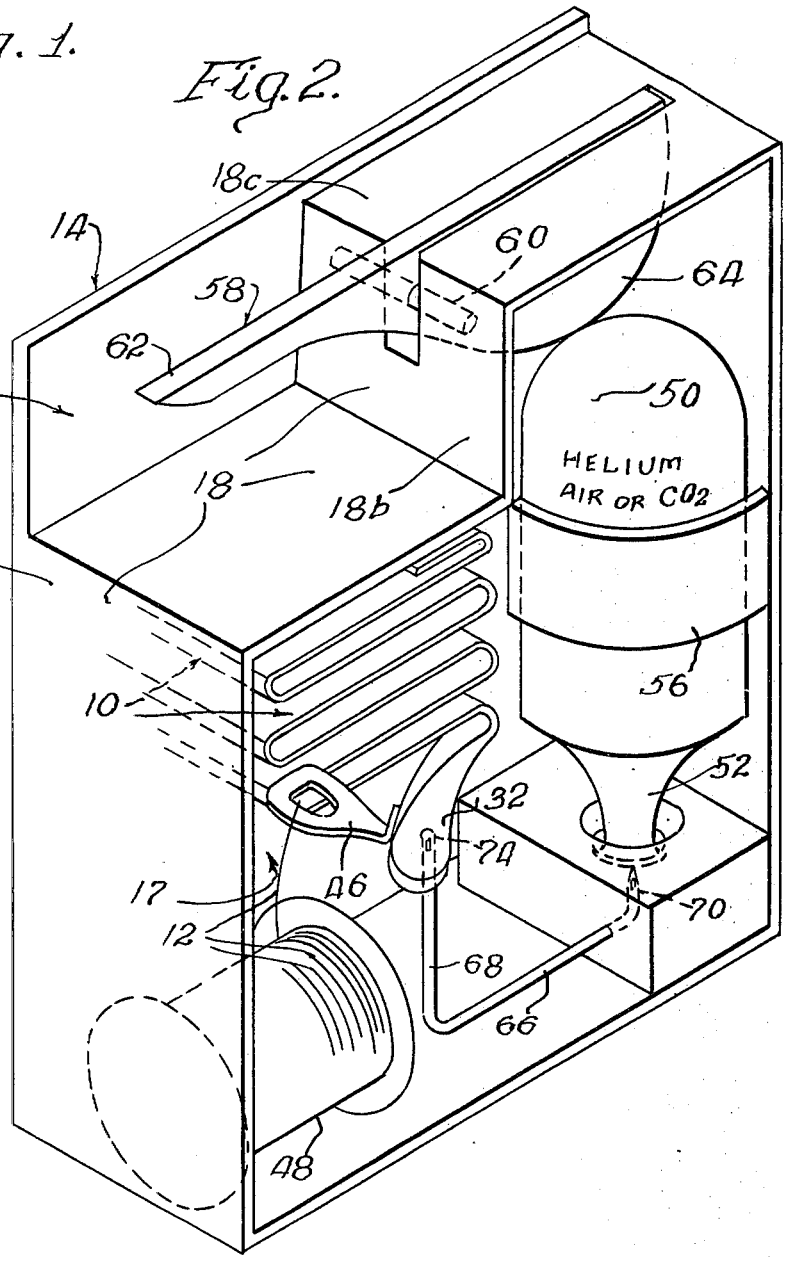
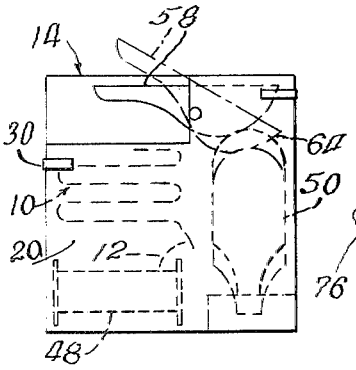
Fig. 3.
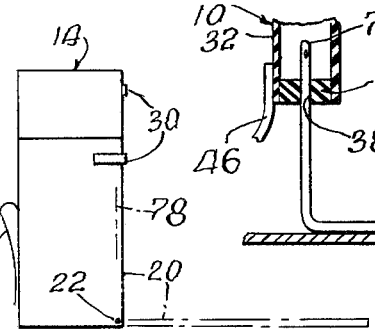
Fig. 4.
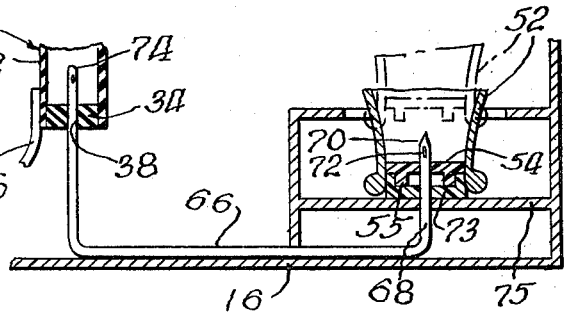
Fig. 5.

RESCUE LOCATOR SIGNAL PACKAGE

OBJECTS OF THE INVENTION

A broad object of the invention is to provide a novel rescue locator signal package including a deflated and collapsed balloon and a cartridge of compressed gas for inflating the balloon, for enabling the balloon to soar to produce a signal that can be observed at a great distance, for use in cases where a person is lost or has had an accident.

Another object is to provide a package of the foregoing character which is extremely small and of light weight whereby to facilitate its being carried on the person, and further wherein it is extremely simple and easy to operate for filling and releasing the balloon for correspondingly producing the desired signal, so that those steps can be taken by a person who may be partially incapacitated and would find it difficult to manipulate such a device.

Still another object is to provide a package of the foregoing character that is of extremely simple design and construction, and hence inexpensive and thereby constituting a throw-away item.

DESCRIPTION OF A PREFERRED EMBODIMENT

In the drawings:

FIG. 1 is a simple view, devoid of details, showing the device of the invention in signalling condition;

FIG. 2 is a perspective view of the device in the form of a package which includes a casing containing all of the other components including the balloon in deflated condition;

FIG. 3 is a small-scale front view of the device with the cover in place;

FIG. 4 is an end view of the package indicating the manner in which the casing is opened for releasing the balloon; and FIG. 5 is a fragmentary view showing details of the needle tube and related elements.

Referring in detail to the accompanying drawings, the device is represented in FIG. 1 as including a balloon 10 in inflated condition, to which a tether line 12 is tied, and including a base 14 which also includes a casing for containing the balloon and the other components of the device as described in detail hereinbelow. The balloon is of course inflated with gas, preferably helium, although air or $CO_2$ may be used in certain instances as referred to again hereinbelow. The base 14 identified in FIG. 1 is shown in perspective view in FIG. 2 and includes a casing 16 of suitable shape and size for containing the components as referred to hereinbelow, and may be structurally of any desired design. For example, the casing has an open side 17 which may be considered the front, or the top when the casing is laid down in use. In this instance, the outline shape is rectangular with surrounding side walls 18 forming a corner portion indented as at 19. The casing includes a cover or door 20 hinged at 22, the cover being appropriately shaped to the open side of the casing. The cover when in closed position is releasably or temporarily held in such position by a suitable means 30 which may be adhesive tape or similar element, and when theuser desires to use the package, he merely pulls the tape 30 off and permits the door or cover to open to the position shown in FIG. 4, exposing all of the other components in the casing. The cover may be detachably held to the casing, as by a snap-catch, instead of being hinged, in a known manner, if desired.

The balloon 10 is contained in the casing in deflated and collapsed form; it may be of any desired kind, as of rubber or plastic, and has a neck portion 32 with a sphincter or self-closing valve 34, FIG. 5, therein of known kind having a central aperture.

For manually releasing the balloon, as referred to again hereinbelow, a tab 46 is provided, secured to the neck of the balloon and accessible to the user when the casing is open. The tether line is secured to the tab, being normally reeled on a spool 48 rotatably mounted in the casing.

A cartridge 50 of known kind is provided, this cartridge including lighter-than-air gas in compressed form, as referred to above. The cartridge has a neck 52 in which is a puncturable disc 54 at the extended end of the neck. The disc 54 is of known kind, preferably with a depending annular flange 55, and the disc may have a limited amount of resilience. The cartridge 50 is mounted in any suitable manner such as by means of a keeper 56, for limited sliding movement between an inactive position, uppermost in FIG. 2, and an active position, lowermost in FIGS. 3 and 5. When it is moved to its active position, it is punctured as referred to below.

The cartridge may be held in its inactive position by friction, and it is moved to active position by means of a manually manipulable lever 58 pivoted in the casing in a suitable manner, such as on a pin 60 mounted on the wall element **18*b*. The lever has a handle element 62 which for convenience may extend into the corner indentation 19, but of course the cover may be of any pre-selected and desired shape, to leave the lever 58 exposed as shown, or, instead, to cover it. The handle element 62 is grasped by the hand and raised, and a cam element 64 on the opposite end engages the cartridge. The lever 58 normally assumes an inactive position shown in FIG. 2 and to move the cartridge, the lever is swung to upper position, i.e., clockwise as viewed in FIG. 3, and the cam element 64** thereby moves the cartridge downwardly to active position as stated.

The location of the pivot pin 60 is selected according to the degree of mechanical advantage desired; for example, in the case of badly injured person, or a small person, greater mechanical advantage may be desired, and in such case, the pin 60 may be located farther toward the cam end of the lever (to the right FIGS. 2 and 3), and for that purpose, the pin 60 may be mounted on the top wall element **18*c***. Similarly, the cam is preselected as to shape and size to effect the desired movement of the cartridge for a given throw of the lever. However, a wide variation of details such as this are within the scope of the invention.

A needle tube 66 is mounted in the casing, having a first end 68 provided with a puncturing point 70 and an aperture 72. The needle tube is preferably provided with a cupshape sealing member 73 supported by a casing element 75. The member 73 may also have a limited amount of resilience, and it receives the annular flange 55, and the member and disc together produce a seal against the escape of gas from the cartridge except through the needle tube. The needle tube at its other end has an element 74 extending through the aperture 38 in the sphincter valve 34. Upon puncturing of the cartridge 50, the gas flows through the needle valve into the balloon and inflates it. The sphincter valve is effective for friction-gripping the needle tube and holding the balloon thereon, even when the balloon is inflated. Upon the balloon being so inflated, it is forced out through the open side of the casing, and whether the casing is upright, as in FIG. 2, or lying with the open side up (in the same position as represented in FIG. 1), the balloon remains on the needle tube as stated.

After the balloon is fully inflated, in normal use, the user grasps the tab 46 and pulls the neck portion off of the needle tube and releases the balloon which then rises to its full height according to the length of thetether line. The casing is preferably of sufficient weight to hold the balloon, resting on the ground. The casing is provided with a clip 76 for securing to the user's belt, or his pack, etc. Also it is within the scope of the invention to secure the balloon by means to tying the tether line onto a fixed object, such as a tree, rock, etc.

The adhesive tape 30 and the pull tab 46 may be removed or released easily, by holding the device between the knees, or gripping them by the teeth, which is a great consideration if the user should be partially incapacitated.

The balloon may be coated with phosphorescent material, or reflective material, for aiding in its visibility, and of a color to contrast with the surroundings. It has been found that a balloon of phosphorescent orange color of 1 foot in diameter can be easily seen at 2 miles distance with the aid of binoculars. Also, tests have shown that a package can be made sufficiently compact for easy carrying that will accommodate a cartridge to inflate a balloon of 14" to 16" diameter, and possibly even 18". As indicated above, however, the invention is not limited to specific size and proportions. The balloon is rendered more visible or conspicuous by the bobbing action thereof due to the wind. The arrangement can be such that the balloon will rise to great heights according to the length of the tether line, which may be madeof material, many of which are available, for providing great length with small weight. A balloon of about 14"-16" in diameter will rise to approximately 100-150 feet, carrying a tether line of sufficient strength to hold it, and those components together with a cartridge containing a sufficient amount of gas, will constitute a complete package with the container that is sufficiently compact and light in weight, as to be easily carried on the person.

The package normally is made of such dimensions and proportions to provide the most effective signal for any situation, such for example as in the case of a person hiking, ski-ing, mountain climbing, etc. It is of course desired to have the balloon as large as practicable and to rise in the air to as great height as practicable, but these considerations must be measured against weight and size so that it can easily be carried without interfering with the main purpose of the user's endeavor, such as hiking, etc.

Another use of the device is in scuba diving; for such use the device is basically the same, but with minor variations—instead of helium, compressed air or $CO_2$ may be used, with corresponding convenience and economy, and the casing 16 is sealed against the entrance of water thereinto. This sealing effect may be provided by a tight fit of the cover 20 with the casing, or by providing removable sealing tape therearound as fragmentarily indicated at 78. In the case of scuba diving, the package may be of greater weight because of the buoyancy condition of the body, with equipment, in the water.

The foregoing has to do with a package of such character as to be carried on the person, both on land and in the water, but on the other hand where weight is no problem, such as in a vehicle—a car, a boat, an airplane, etc., the device can be made extremely large and the tether line extremely long so that the balloon would rise to a greater height and be observable at very great distances and this would be particularly effective in such cases as in a forest, or in relatively isolated areas, whether in the desert or on ice floes, etc., and on the sea where the balloon may be made to rise great distances to overcome the curvature of the earth. The device is extremely simple in design and construction, requiring inexpensive materials and inexpensive fabricating methods, whereby to provide a device of throw-away character.

I claim:

1. A rescue locator package comprising, a casing, a deflated and collapsed balloon in the casing, and having a fillable end with a self-closing valve therein, a cartridge of compressed gas in the casing and movable between an inactive position and an active position, means normally holding the cartridge in its inactive position and so holding it in normal handling of the package, a needle tube fixedly mounted in the casing having one end extending through the self-closing valve in the balloon and communicating with the interior of the balloon and the other end having a puncturing point positioned and operable for puncturing the cartridge when the cartridge is moved to active position, and the needle tube, in response to so puncturing the cartridge, extending into the cartridge and thereby establishing communication between the cartridge and the balloon, filing the balloon with the gas, the fillable end of the balloon being friction-held on the needle tube, and the remainder and body portion of the balloon being loosely contained in the casing and expellable therefrom in response to being filled, and pursuant to being so expelled being normally friction-held on the needle tube and the latter holding the balloon until it is manually released therefrom, a tether line interconnecting the fillable end of the balloon and the casing, and manually manipulable means for moving the cartridge to active position and thereby puncturing it, the manually manipulable means having at least a portion extending into the interior of the casing, and all of the remaining elements being entirely contained in the casing.

2. A rescue locator signal package according to claim 1 wherein, the casing forms a base, of sufficient weight to hold the balloon against free floating or soaring, resting on the ground.

3. A rescue locator signal package according to claim 1 wherein, the manipulable means is a lever pivoted in the casing, and said portion thereof that extends into the interior of the casing being constituted by a cam element engaging the cartridge, and the lever being responsive pursuant to swinging movement by the user for moving the cartridge to active position.

4. A rescue locator signal package according to claim 1 wherein, the tether line is reeled on a rotatable spool contained within the casing.

5. A rescue locator signal package according to claim 1 wherein, the casing is completely enclosed and includes a cover normally in a position covering an otherwise open side of the casing, and the casing includes a quick-releasable means for normally holding the cover in its normally closed position, and the cover when so released moves to an open position exposing all of the other components contained within the casing.

* * * * *